US009303470B1

(12) United States Patent
Keast

(10) Patent No.: US 9,303,470 B1
(45) Date of Patent: Apr. 5, 2016

(54) DRILLING RIG WITH TOP DRIVE WITH DUAL OPENING ELEVATOR

(71) Applicant: Larry G. Keast, Houston, TX (US)

(72) Inventor: Larry G. Keast, Houston, TX (US)

( * ) Notice: Subject to any disclaimer, the term of this patent is extended or adjusted under 35 U.S.C. 154(b) by 0 days.

(21) Appl. No.: 14/626,888

(22) Filed: Feb. 19, 2015

Related U.S. Application Data

(60) Provisional application No. 61/944,516, filed on Feb. 25, 2014.

(51) Int. Cl.
*E21B 19/06* (2006.01)
*E21B 15/00* (2006.01)
*E21B 19/20* (2006.01)

(52) U.S. Cl.
CPC ..... *E21B 19/06* (2013.01); *E21B 15/00* (2013.01); *E21B 19/20* (2013.01)

(58) Field of Classification Search
CPC ..... E21B 19/02; E21B 19/06; E21B 19/07; E21B 1/02; E21B 3/02
See application file for complete search history.

(56) References Cited

U.S. PATENT DOCUMENTS 1,021,984 A * 4/1912 Holmes ..... E21B 19/06 294/90
3,838,613 A 10/1974 Wilms
4,421,179 A 12/1983 Boyadjieff
6,279,661 B1 * 8/2001 Matherne, Jr. ..... E21B 19/02 138/103
7,921,939 B1 4/2011 Keast et al.
7,984,757 B1 7/2011 Keast et al.
8,127,836 B1 * 3/2012 Keast ..... E21B 19/16 166/75.11
8,590,610 B1 11/2013 Keast et al.
8,727,039 B1 * 5/2014 Keast ..... E21B 44/04 175/203
2006/0113087 A1 * 6/2006 Springett ..... E21B 19/06 166/380
2008/0093870 A1 * 4/2008 Ellis ..... E21B 19/06 294/86.33
2013/0055858 A1 * 3/2013 Richardson ..... E21B 19/164 81/57.11
2013/0312978 A1 * 11/2013 Galle, Jr. ..... E21B 17/1057 166/355

* cited by examiner

*Primary Examiner* — Waseem Moorad
*Assistant Examiner* — David Carroll
(74) *Attorney, Agent, or Firm* — Buskop Law Group, PC; Wendy Buskop

(57) ABSTRACT

This oilfield drilling rig uses a top drive with a hydraulic actuated drill pipe handling tool known as a dual opening elevator. This tool eliminates the need for a typical complicated elevator rotation mechanism with troublesome concentric hydraulic seals. In operation, after opening the front, picking up a stand at the racking board and putting it in the string, the back may then be opened to allow moving the elevator off the drill pipe toward the front of the rig to prevent elevator wear while drilling and to allow drilling down close to the rig floor. Time is saved because no rotation is required, and down time is saved because there are no troublesome concentric seals which commonly leak.

17 Claims, 9 Drawing Sheets

FIGURE 2A
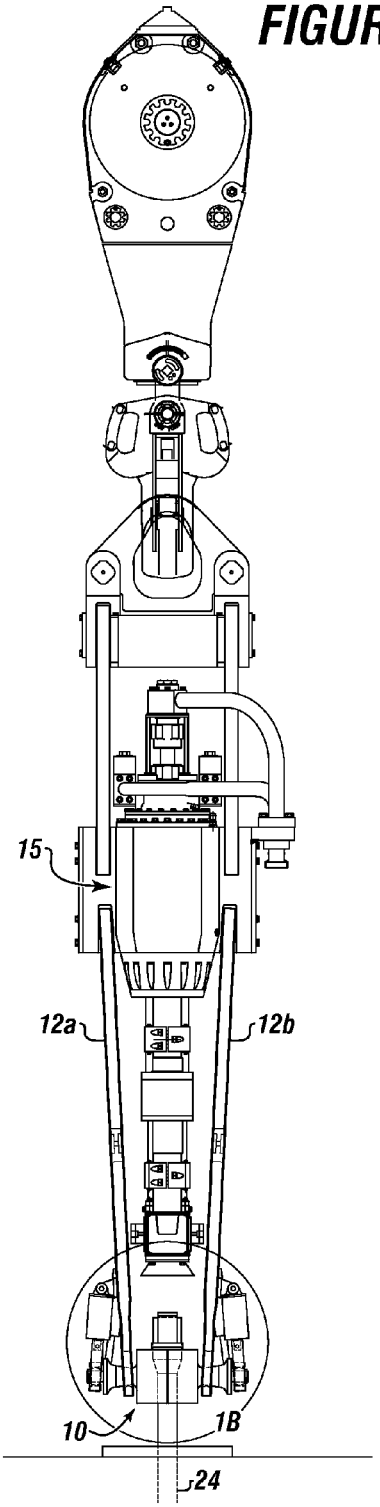
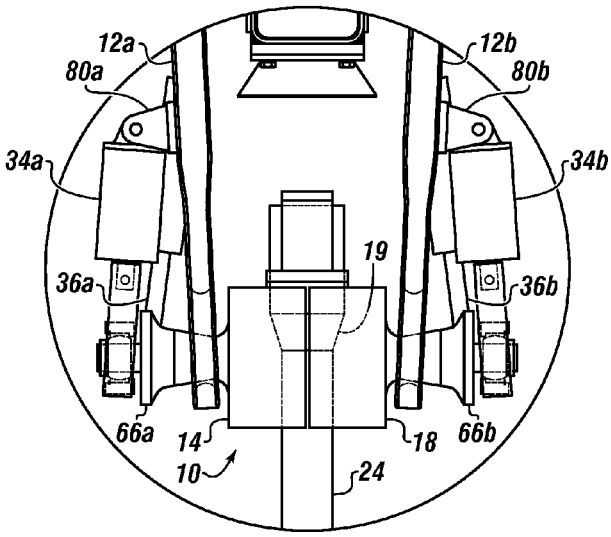
FIGURE 2B

DRILLING RIG WITH TOP DRIVE WITH DUAL OPENING ELEVATOR

CROSS REFERENCE TO RELATED APPLICATION

The current application claims priority to and the benefit of U.S. Provisional Patent Application Ser. No. 61/944,516 filed on Feb. 25, 2014, entitled "DRILLING RIG WITH TOP DRIVE WITH DUAL OPENING ELEVATOR". This reference is hereby incorporated in its entirety.

FIELD

The present embodiments generally relate to a drilling rig with a top drive and a dual opening elevator capable of supporting and releasing oil field tubulars and other oilfield equipment.

BACKGROUND

A need exists for a drilling rig with an apparatus to aid in the handling of drill pipes for drilling wells. Current methods and apparatuses used for these operations involve a complex assembly for rotating the elevator to allow for latching on to the drill pipe, then subsequently rotating in order to allow releasing the drill pipe from another side.

These methods are time consuming, involve a significant level of human labor interaction, and are potentially unsafe to workers. Handling of heavy oilfield equipment is not only dangerous, but entails significant costs when undue time is required to complete essential tasks.

Further, apparatuses currently used on drilling rigs are mechanically complex, requiring several rotating elements and numerous pairs of concentric dynamic hydraulic seals. The more complex a piece of equipment is, the more maintenance it will require and the greater the chance of failures.

A need exists for a drilling rig that can grab tubulars from multiple directions and can be more automated to address risks to personnel and efficiency of use.

A need exists for drilling rig with a hydraulic actuated drill pipe handling tool for use with oilfield top drives.

A need exists for drilling rig with a hydraulic actuated drill pipe handling tool that eliminates the need for a complicated link and elevator rotation mechanism.

A need exists for a drilling rig with a hydraulic actuated drill pipe handling tool that eliminates the need for troublesome concentric hydraulic seals.

The present embodiments meet these needs by providing an elegant and simple to use design which can be automated to perform reliably in a repeatable, safe, and efficient manner while remaining relatively maintenance and trouble free.

BRIEF DESCRIPTION OF THE DRAWINGS

The detailed description will be better understood in conjunction with the accompanying drawings as follows:

FIG. 2A shows a front view of a dual opening elevator attached a top drive.

FIG. 2B shows a detail view of a dual opening elevator.

Figure 1:
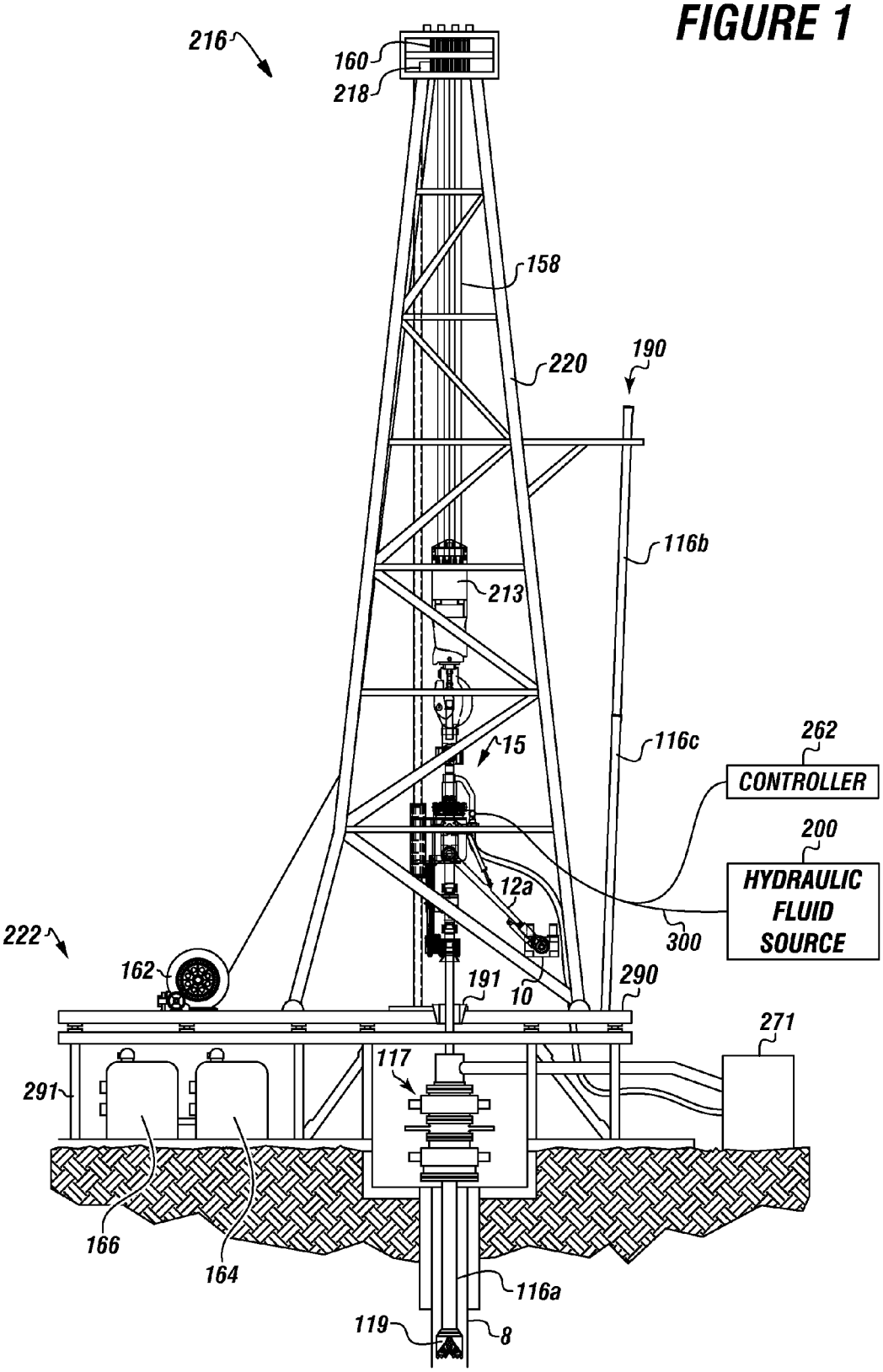
FIG. 1 shows a side view of a drilling rig with a top drive with a dual opening elevator.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments relate to a drilling rig for rotating drill pipe in a wellbore using a top drive with a dual opening elevator mounted to a derrick or tower.

The drilling rig with a dual opening elevator can be used with a top drive. The dual opening elevator allows for a user to grab a drill pipe by opening and closing one side of the dual opening elevator and subsequently releasing the drill pipe by opening an opposite side of the dual opening elevator.

The drilling rig with a dual opening elevator can be used to assist oilfield top drives in handling drill pipe.

The drilling rig with dual opening elevator eliminates the need for a complicated link and elevator rotation mechanism with troublesome concentric seals.

Time is saved with this drilling rig because rotation of the links and elevator is not required.

Rig down time is also saved because there are no troublesome concentric seals to replace. Rig reliability is improved.

The dual opening elevator of this drilling rig precludes the need to rotate the dual opening elevator in between the steps of engaging and releasing drill pipe.

The drilling rig includes a derrick centered over the wellbore. The derrick can have a crown. The derrick can be attached to a drilling rig base. At least one crown sheave can be mounted to the crown of the derrick. One or more cables can be mounted to at least one sheave.

A lifting block can be connected to the cables.

The lifting block can be a solid block. The lifting block can be made from a first sheave mounted on one side of the lifting block and a second sheave mounted to an opposite side of the lifting block.

A top drive housing can attach to the lifting block. A top drive can be suspended from the top drive housing. A pair of links can connect to the top drive housing and an elevator can connect to the pair of links for engaging a drill pipe with a bit or a plurality of longitudinally connected drill pipes with a bit.

The top drive in the housing can use a top drive motor to rotate the drill pipe or plurality of connected pipes with a bit in the wellbore.

The top drive can be suspended from the top drive housing. The top drive can have a rotating stem spinably connected with a top drive motor, a heavy thrust bearing disposed about the rotating stem within the top drive housing, an inside blowout preventer connected to the rotating stem and to a saver sub, an upper clamp assembly locking the connection between the rotating stem and the inside blowout preventer, and a lower clamp assembly locking the connection between the inside blowout preventer and the saver sub.

The top drive, in an embodiment, can sustain 250 tons of static load and 158 tons at 100 rpm, with 35,000 Ft-lbs max drilling torque with a 170 rpm max. The top drive can be banjo mounted.

A drawworks can connect to a drawworks motor for raising or lowering the lifting block. A blowout preventer stack can be positioned over the wellbore with the drill pipe passing through the blowout preventer stack.

A mud pump can connect to the drill pipe for use while the drill bit rotates. A power supply can power the drawworks motor, and a controller can be in communication with the top drive to operate the top drive, the mud pumps, the hydraulic fluid flow, and other apparatus of the drilling rig.

In embodiments, the power source can be a hydraulic system having a retractable hinge pin in a hinge pin housing, a bore inside of the retractable hinge pin, a hydraulic fluid in the bore, a piston cylinder having a piston chamber, a fluid conductor within the piston cylinder, a first seal positioned between the piston cylinder and the retractable hinge pin, a hinge pin housing head in fluid communication with the piston chamber and the fluid conductor, and a retract passage between the piston chamber and a retract area.

In embodiments, the hydraulic system can include a hydraulic actuation assembly in the hinge pin housing. In embodiments, the hydraulic actuation assembly can contain the piston cylinder.

A pair of slips can be disposed on top of the wellbore between the blowout preventer stack and the drill bit.

A dual opening elevator can be used with the top drive of the drilling rig. The dual openings can allow for a user to grab a drill pipe by opening and closing one side of the dual opening elevator and subsequently release the drill pipe by opening an opposite side of the dual opening elevator.

The dual openings preclude the need to rotate the dual opening elevator in between the steps of grabbing and releasing.

Current methods and apparatuses to grab a drill pipe, position the drill pipe, and release the drill pipe are rotated to allow for release of the drill pipe. Upon release of a drill pipe, the methods and apparatuses to grab a drill pipe must be rotated again to allow for the grabbing of a new pipe.

As oilfield equipment is often bulky, difficult to manipulate, and heavy, this entails a significant amount of time to accomplish these tasks. Further, it often requires human interaction to clamp and unclamp drill pipes, as well as manipulate the rotating assembly.

The present application makes use of the following terms. While descriptive names have been utilized for clarity and easier understanding of the embodiments, it should be noted that the terms below can carry a broader meaning.

The term "link" as used herein can refer to a stabilizing member to which a component is attached. The link can be constrained against rotation and is capable of supporting and moving various components of the drilling rig.

The term "segment" as used herein can refer to a functional component of the drilling rig or the dual opening elevator. A segment can be comprised of multiple parts, but is referred to as a single unit for convenience.

The term "elevator segment" as used herein can refer to a component or set of components of the dual opening elevator. Elevator segment generally relates to one component side of the dual opening elevator that can separate from another component side of the dual opening elevator to form an opening while in an open position. Opposing elevator segments generally fit complementarily and fairly snugly with each other when in a closed or locked position.

The term "cavity" as used herein can refer to a shaped indentation in any component of the drilling rig or the dual opening elevator.

The term "drill pipe opening" as used herein can refer to an opening formed when two cavities are aligned. While embodiments shown are designed for a pipe used in oilfield operations, this opening can be used to grasp other equipment.

The term "drill pipe" as used herein can refer to any piece of equipment required to be positioned or moved by the dual opening elevator. Embodiments shown make use of a drill pipe as used in oilfield applications.

The term "fastener" as used herein can refer to a mechanism for connecting components of the drilling rig. The fastener can be an item such as a bolt, screw, pin connector, and the like.

The term "rotary actuator" as used herein can refer to a means of physically moving the elevator segments to cause an opening to be formed or physically moving the elevator segments to cause the elevator segments to be abutted together. The rotary actuator can be a manual or automated means.

The term "elevator rotator" as used herein refers to a means of physically rotating the entire dual opening elevator assembly. The elevator rotator will typically be used to horizontally orient the dual opening elevator, but can be used for various reasons as required by the application. The elevator rotator can be a manual or automated means.

The term "bearing retainer" as used herein can refer to any means of maintaining a bearing in a desired location, such as a groove with a snap ring.

The term "clevis" as used herein can refer to an attachment means allowing for some movement of the attached components with respect to each other. For example, the clevis can be an oversized, or a slotted hole.

The present embodiments relate to a drilling rig for rotating pipe in a wellbore using a top drive with a dual opening elevator mounted to a derrick or tower. The drilling rig can comprise a derrick centered over the wellbore, a lifting block, a top drive housing, a top drive, a drawworks, and a mud pump.

The drilling rig supports and positions the top drive with a dual opening elevator to enable the dual opening elevator to grab drill pipes and release drill pipes.

In embodiments, a dual opening elevator can be supported by at least one link attached to a top drive.

Turning now to the Figures, FIG. 1 shows a drilling rig 216 for use in drilling wells. The drilling rig can include a derrick 220 having a crown 218.

The drilling rig 216 can have has a drilling rig base 222 connected to a drilling rig floor substructure 291.

The drilling rig 216 can have a lifting block 213 that can be secured to a cable 158. The cable 158 can extend from the lifting block 213 over at least one sheave 160 mounted to the top of the derrick 220 at the crown 218.

A drawworks 162 can be connected to a drawworks motor 164 for turning the drawworks 162, and for raising or lowering the lifting block 213.

The drawworks motor 164 can be energized from a rig power supply 166, such as a hydraulic power supply.

The top drive 15 can be lifted or lowered by the lifting block 213 when pulled by the cables of the drawworks 162 which can be moved by the drawworks motor 164.

A dual opening elevator 10 can be attached to a link 12*a* attached to the top drive 15.

A pipe 116*a* can be engaged with the drilling rig 216 at one end and with a drill bit 119 on the other end within the wellbore 8.

A stand of pipes, including pipe 116*c* connected to pipe 116*b* can be maintained in a racking position 190 relative to the drilling rig floor 290.

A hydraulic fluid source 200 for powering the top drive 15 is shown. The hydraulic fluid can pass through a conduit 300. Slips 191 are also shown at the top of the wellbore 8.

A mud pump 271 is shown for engaging the drill pit via the blowout preventer stack 117 over the wellbore 8.

A controller 262 is also shown for operating the top drive 15, the hydraulic fluid source 200, the mud pump 271 and other equipment on the drilling rig 216.

FIG. 2A shows a front view of a dual opening elevator attached a top drive.

In this embodiment, a top drive 15 can be engaged to a dual opening elevator 10 supported using a pair of links 12*a* and 12*b*.

The dual opening elevator 10 can be engaged by a single link in embodiments. In order to best illustrate all the claimed elements of the invention, the embodiments shown in this and the following figures make use of two links.

The dual opening elevator when closed as shown can engage and liftably support a drill pipe 24.

FIG. 2B shows a detail view of a dual opening elevator 10.

In this embodiment, the dual opening elevator 10 can be seen engaging and liftably supporting the drill pipe 24.

A mechanical feature 19 can be used to aid in supporting the drill pipe 24. In this embodiment, the mechanical feature 19 is shown as a conical bore.

In this embodiment, the first elevator segment 14 and the second elevator segment 18 can be connected to adapters 66*a* and 66*b* respectively.

The first elevator segment 14 and second elevator segment 18 can be identical in physical structure and properties, or be of different structures and properties.

The first elevator segment 14 and a second elevator segment 18 can be designed to be complementary to each other and mechanically fit together.

A pair of rotary actuators 34*a* and 34*b* is shown.

The rotary actuators 34*a* and 34*b* can be used to open and close the dual opening elevator 10. The rotary actuators can each be attached to the links with a clevis 80*a* and 80*b* in this embodiment.

The rotary actuators 34*a* and 34*b* can be linear or electrical actuators in embodiments.

A pair of elevator rotators 36*a* and 36*b* can be used to rotate the dual opening elevator 10 however only one elevator rotator may be required in embodiments.

The elevator rotators rotate the dual opening elevator around the eyes of the links 12*a* and 12*b*.

Figure 3A:
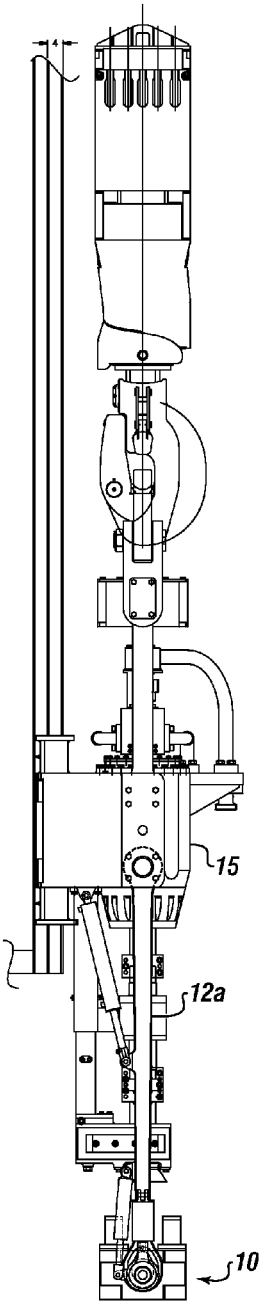
FIG. 3A shows a side view of a dual opening elevator attached to a top drive.

FIG. 3A shows a side view of a dual opening elevator 10 attached to a top drive 15.

In this embodiment, the dual opening elevator 10 can be seen in an "inline position" with the top drive 15. The dual opening elevator 10 can be connected to the top drive via link 12*a*.

Figure 3B:
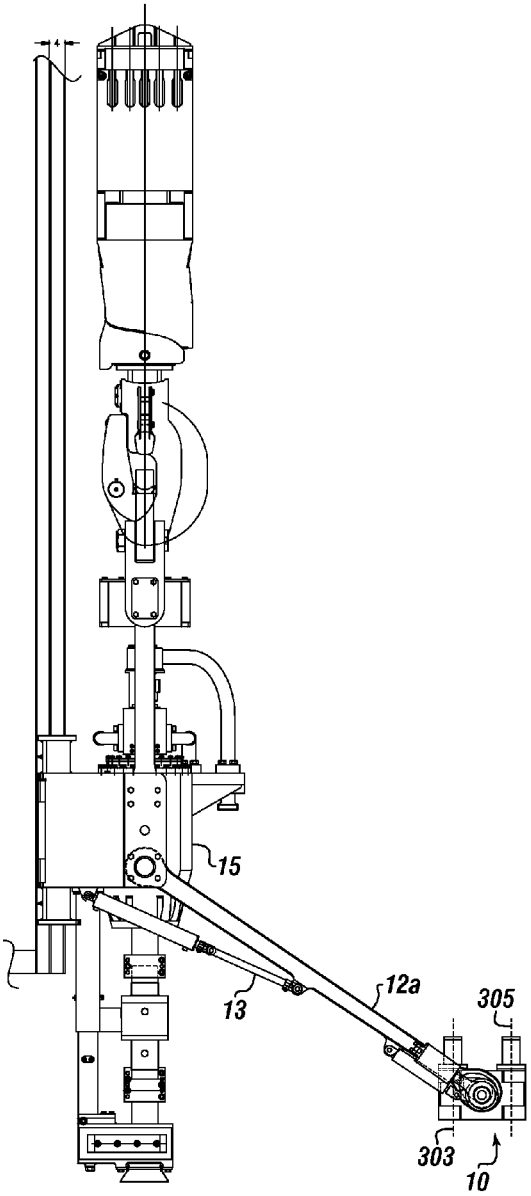
FIG. 3B shows a side view of the dual opening elevator with a link extended.

FIG. 3B shows a side view of a dual opening elevator 10 attached to a top drive 15.

In this embodiment, the dual opening elevator 10 is shown in a "kicked-out position" from the top drive 15. The dual opening elevator 10 can be connected to the top drive via link 12*a*.

In this embodiment, the link 12*a* has been displaced by an actuator 13 to move the dual opening elevator 10 in a swinging motion.

Various other means to attach the link 12*a* to the top drive 15 can be employed, as well as various other methods of actuating the link.

In this embodiment, the dual opening elevator 10 can be rotated by the elevator rotators to rotate to a user desired orientation.

Also shown are fastener axes 303 and 305, wherein each fastener assembly can rotate about a fastener axis to open and close the dual opening elevator.

Figure 3D:
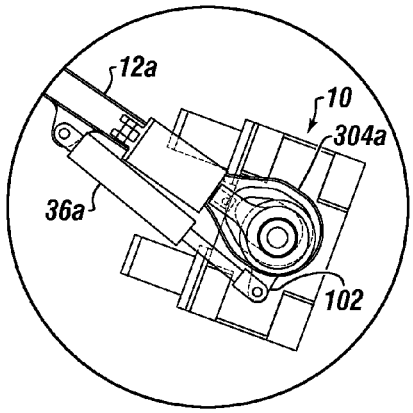
FIG. 3D shows a detail view of the dual opening elevator in the rotated positions of FIG. 3C.
Figure 3C:
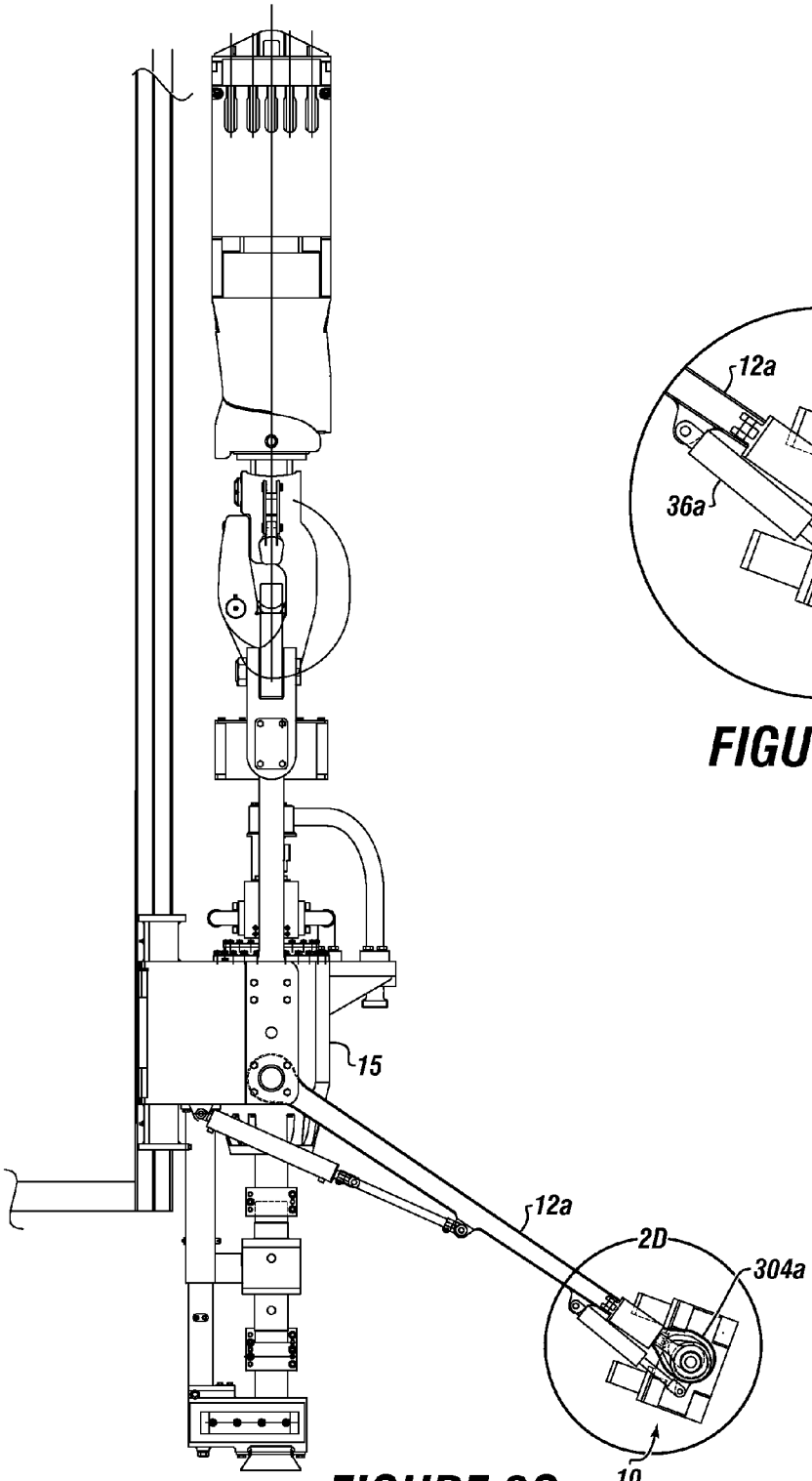
FIG. 3C shows a side view of a dual opening elevator attached to a top drive with link extended and elevator rotated from the position of FIG. 3B.

FIG. 3C shows a side view of a dual opening elevator 10 attached to a top drive 15. The eye 304*a* of the link 12*a* is depicted.

This Figure depicts the dual opening elevator 10 rotated within the pair of links.

FIG. 3D shows a detail view of the dual opening elevator 10. The eye 304*a* of the link is shown in this embodiment.

In this embodiment, the dual opening elevator 10 can be seen rotated again.

The dual opening elevator can be able to rotate through a plurality of angles. The angles can be completely variable. A pair of elevator rotators can be used to create the movement.

Elevator rotator 36*a* is shown in this embodiment connected to the link 12*a*. The elevator rotator 36*a* at the bottom end connects to a second connection 102. The second connection 102 can engage an adapter. In this embodiment, the elevator rotator is shown as a hydraulic cylinder.

Figures 4A, 4B, 4C:
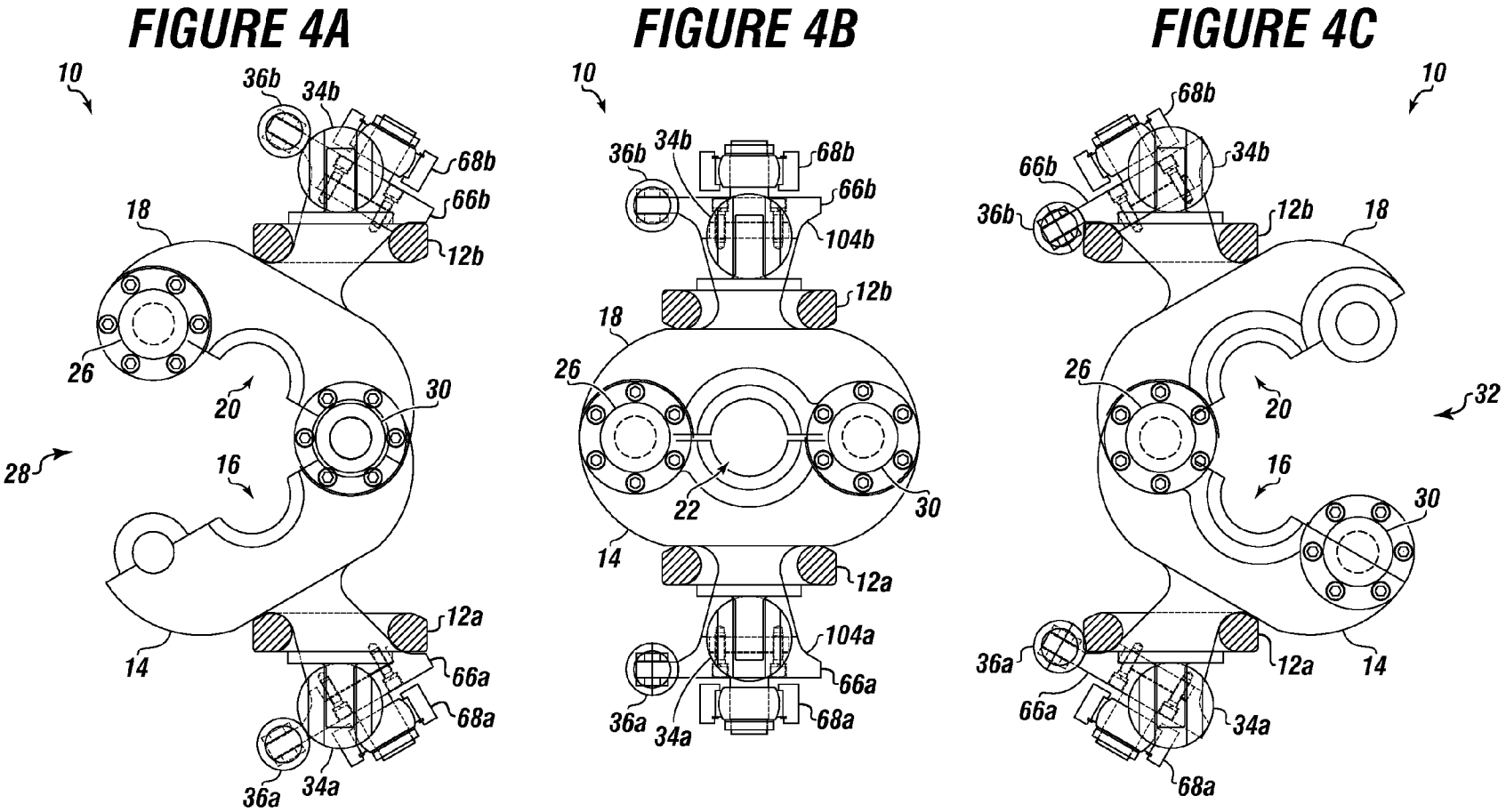
FIG. 4A shows a top view of the dual opening elevator in a first open position.
FIG. 4B shows a top view of the dual opening elevator in a closed position.
FIG. 4C shows a top view of the dual opening elevator in a second open position.

FIGS. 4A, 4B, and 4C show a top view of the dual opening elevator 10 in a first open position as shown in FIG. 4A, a closed position as shown in FIG. 4B, and in a second open position as shown in FIG. 4C.

The dual opening elevator 10 can have a first elevator segment 14 and a second elevator segment 18.

The first elevator segment 14 can have a first cavity 16.

The second elevator segment 18 can have a second cavity 20.

The first cavity 16 and the second cavity 20 can be shaped to engage a drill pipe when the first elevator segment 14 is fastened to the second elevator segment 18 creating an automatic alignment of the cavities.

The first cavity 16 and the second cavity 20 can each comprise one or more mechanical features such as a conical bore, to better engage a portion of a drill pipe.

For example, the cavity can have an 18 degree taper as shown in FIG. 2B to best engage drill pipes complying with American Petroleum Institute (API) standards.

The first cavity mechanical feature, if used, and second cavity mechanical feature, if used, can be the same feature, for optimum performance of the dual opening elevator as required by the application.

In this embodiment, the first elevator segment 14 and the second elevator segment 18 are shown connected to adapters 66*a* and 66*b* respectively.

Adjacent to adapter 66*a* can be a rotary actuator 34*a* which is adjacent to elevator rotator 36*a*.

All the rotary actuators and all the elevator rotators of these FIGS. 4A, 4B, and 4C can be connected to the power source.

Adjacent to adapter 66*b* can be rotary actuator 34*b* which is adjacent to and connects to elevator rotator 36*b*.

The links 12*a* and 12*b* can support the first elevator segment 14 and the second elevator segment 18 using the adapters 66*a* and 66*b* respectively.

In this embodiment, stop surfaces 104*a* and 104*b* can be part of the adapters 66*a* and 66*b* respectively. The stop surfaces can act to constrain the degree of movement allowed to the first elevator segment 14 or the second elevator segment 18.

The stop surfaces 104*a* and 104*b* can make contact with the links 12*a* and 12*b* to prevent further opening of the first elevator segment 14 or the second elevator segment 18.

Variants of the embodiment include using a single link, a single adapter, and a single rotary actuator.

A first fastener assembly 26 and a second fastener assembly 30 can selectively attach the first elevator segment 14 and the second elevator segment 18. Each fastener assembly can have a fastener axis.

In FIG. 4A the first fastener assembly 26 is shown unfastened while the second fastener assembly 30 is shown fastened to allow the first elevator segment 14 and the second elevator segment 18 to form a first opening 28.

In FIG. 4B the first fastener assembly 26 and the second fastener assembly 30 are shown fastened to lock the first elevator segment 14 and the second elevator segment 18 in a closed position. The first cavity 16 and the second cavity 20 align in this position to form a drill pipe opening 22.

In FIG. 4C the first fastener assembly 26 is shown fastened while the second fastener assembly 30 is shown unfastened to allow the first elevator segment 14 and the second elevator segment 18 to form a second opening 32.

Eye assemblies 68*a* and 68*b* are depicted as the elevator is opened and closed in these three figures.

Figure 5B:
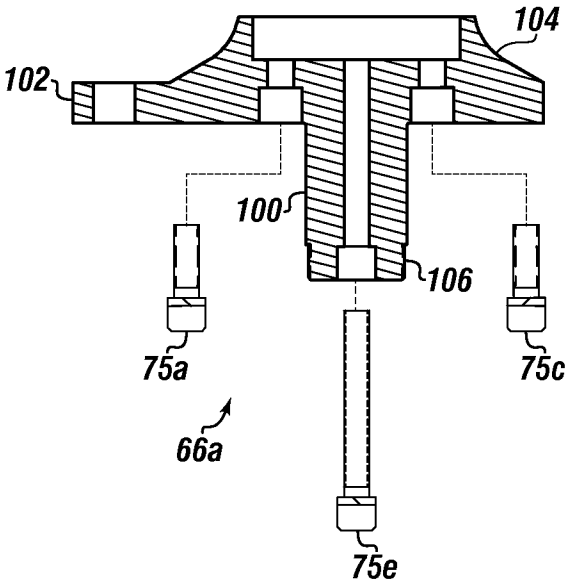
FIG. 5B shows a cut view of the adapter of FIG. 5A along line AA.
Figure 5A:
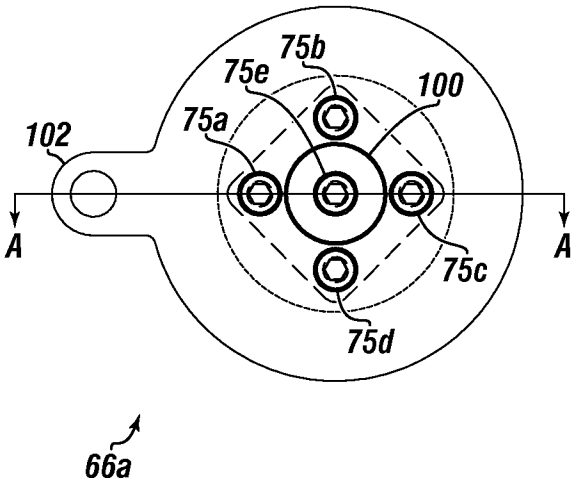
FIG. 5A shows a side view of the adapter of the invention.

FIG. 5A shows a side view of one embodiment of an adapter 66*a*. FIG. 5B shows a cut view of the adapter 66*a* of FIG. 5A along line AA.

Referring to FIGS. 5A and 5B, the adapter 66*a* can have a first connection 106 for engaging the first elevator segment.

In this embodiment, the first connection 106 is shown as a threaded connection.

In this embodiment, the adapter 66*a* can receive a plurality of connectors 75*a*-75*e* to connect to the adapter 66*a* to the first elevator segment.

In this embodiment, the adapter 66*a* can have a bearing shaft 100 that can extend through the eye assembly.

The adapter 66*a* can further have a second connection 102 to the elevator rotator. The second connection 102 is shown in this embodiment as a hole to receive a bolt to secure a clevis pin from the elevator rotator.

Various effective connection configurations can be employed for each of the above.

Connector 75*e* can be used for engagement in the opening in the adapter.

In this embodiment, the adapter 66*a* can have a stop surface 104 to constrain the degree of movement of the elevator segment to which the adapter 66*a* is attached.

Connectors 75*a*, 75*c* and 75*e* can be used to attach the adapter 66*a* to the elevator segment.

Figure 6B:
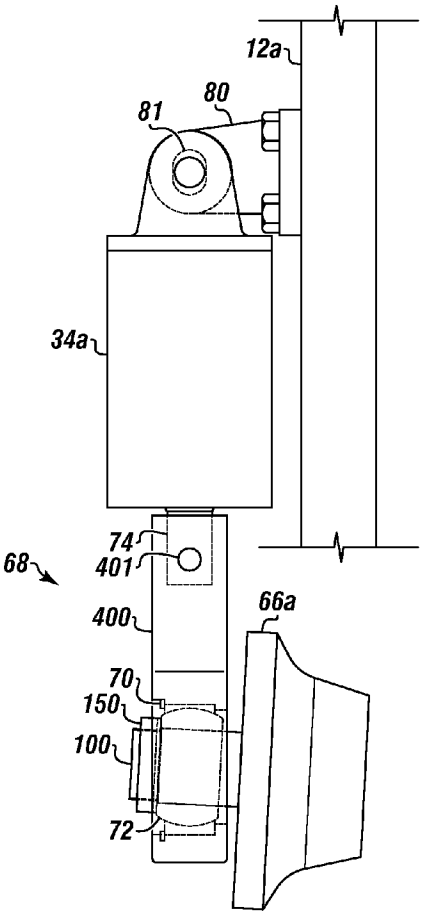
FIG. 6B shows a front view of an eye assembly attached to a rotary actuator.
Figure 6A:
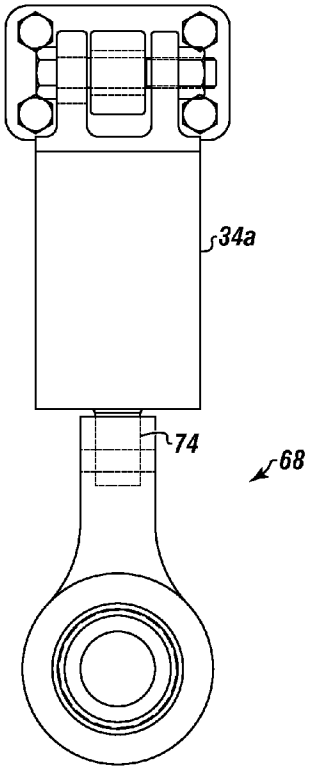
FIG. 6A shows a side view of an eye assembly attached to a rotary actuator.

FIG. 6A shows a side view of an eye assembly 68 attached to a rotary actuator 34*a*.

In this embodiment, the eye assembly 68 is shown having a small end connection 74 depicted as a round pin in a round hole with a cross drilled hole to receive a bolt for engaging the rotary actuator 34*a*.

FIG. 6B shows a front view of an eye assembly 68 attached to a rotary actuator 34*a*.

In this embodiment, eye assembly 68 is shown with a small end connection 74 (female connection) engaging the rotary actuator 34*a* using a connecting pin 401 that can penetrate perpendicularly through an eye housing 400 to lock the eye housing 400 onto a portion of the rotary actuator that extends into the eye housing.

The eye housing 400 can further connect to the adapter 66*a* using an attachment 150, shown here as a nut for retaining the adapter 66*a* onto the eye assembly 68.

In this embodiment, eye assembly 68 can have a bearing 72 and a bearing retainer 70 shown here as a snap ring.

A clevis 80 can be disposed upon the link 12*a* for connecting the rotary actuator to the link 12*a*.

In this embodiment, the clevis 80 can have a slotted hole 81 which allows for movement of the rotary actuator 34*a*.

A bearing shaft 100 can extend through the eye assembly 68.

Figure 7B:
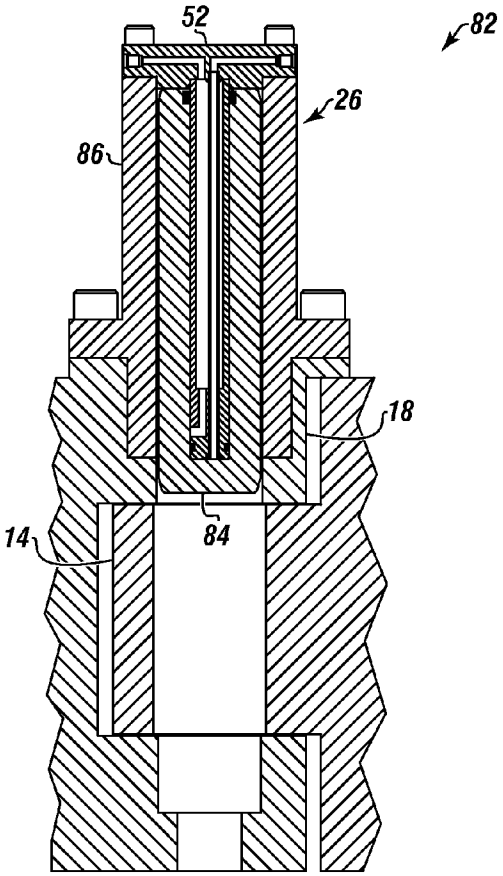
FIG. 7B shows a cut away view of the fastener assembly of FIG. 7A in a retracted position.
Figure 7A:
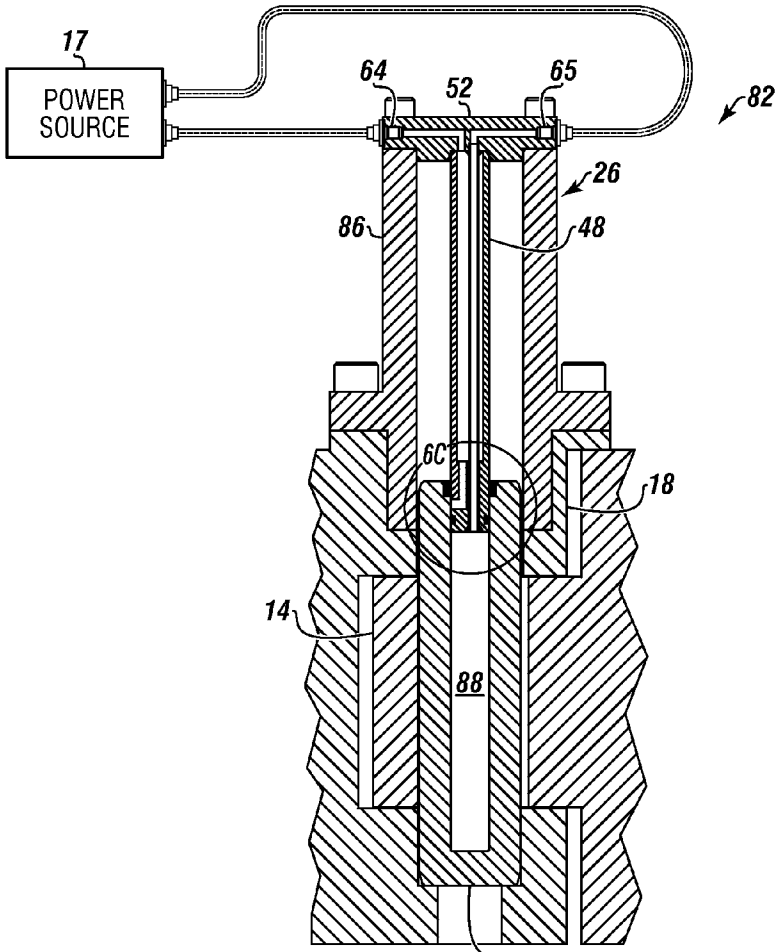
FIG. 7A shows a cut away view of a fastener assembly in an extended position.

FIG. 7A shows a side view of the second fastener assembly having a retractable hinge pin assembly 82 in an extended position.

FIG. 7B shows a side view of the second fastener assembly having a retractable hinge pin assembly 82 in a retracted position.

Figure 7C:
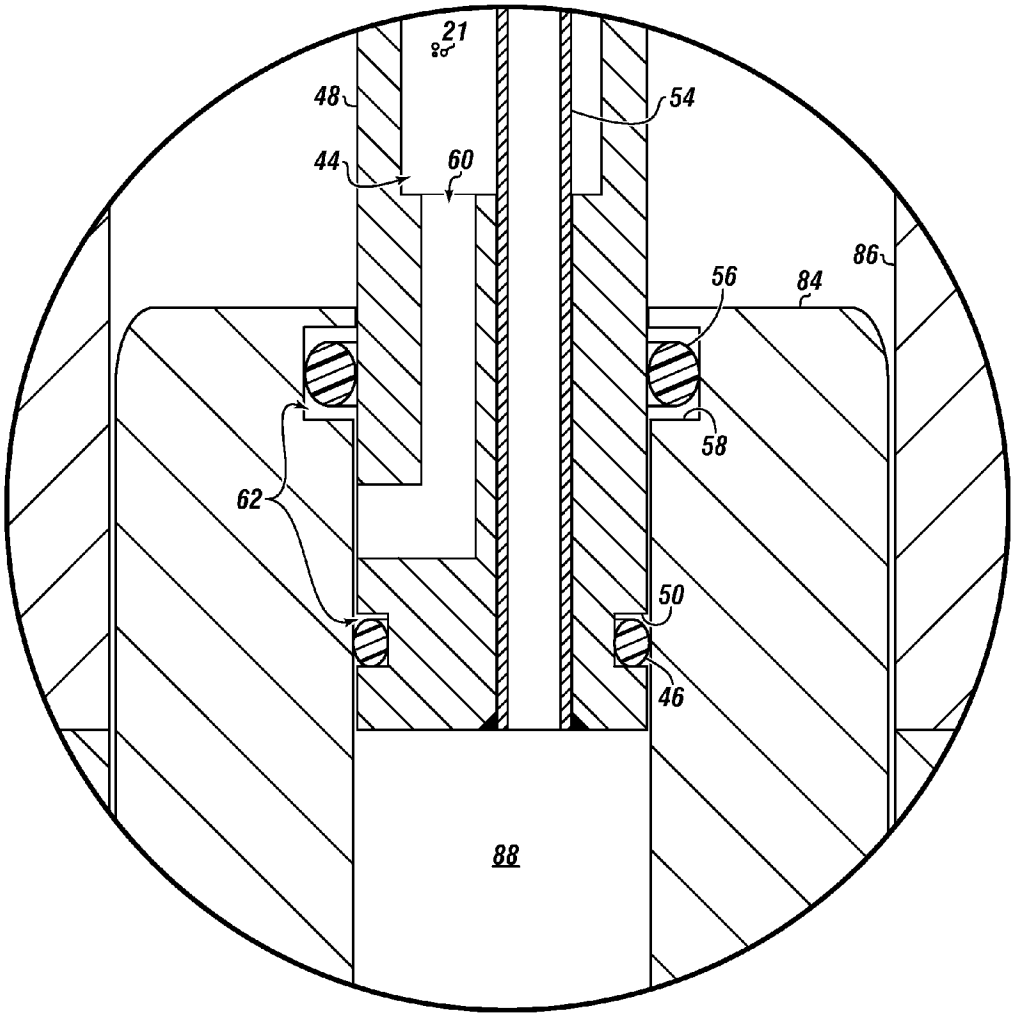
FIG. 7C shows a detail view of the fastener assembly of FIG. 7A.

FIG. 7C shows a detail view of the second fastener assembly of FIG. 7A.

FIGS. 7A, 7B, and 7C show a retractable hinge pin assembly 82 actuated by a power source 17.

In this embodiment, the power source is depicted as a hydraulic power source having a hydraulic fluid 21.

In this embodiment, the retractable hinge pin assembly 82 can have a retractable hinge pin 84 in a hinge pin housing 86 and a bore 88 inside of the retractable hinge pin 84.

A piston cylinder 48 is shown having a piston chamber 44.

A first seal 46 can be positioned between the piston cylinder 48 and the retractable hinge pin 84.

The first seal 46 can be mounted within a first seal groove 50 on the piston cylinder.

A second seal 56 can be positioned between the piston cylinder 48 and the retractable hinge pin 84.

The second seal 56 can be mounted within a second seal groove 58 formed in the retractable hinge pin 84.

A fluid conductor 54 can be within the piston cylinder 48 and below a hinge pin housing head 52.

A retract passage 60 can be between the piston chamber 44 and a retract area 62.

The retract passage 60 and the retract area 62 can be in fluid communication with the piston chamber 44.

A retract port 64 in the hinge pin housing head 52 can be used for flowing the hydraulic fluid 21 into the piston chamber 44 to retract the retractable hinge pin 84.

An extend port 65 in the hinge pin housing head 52 can be used for flowing the hydraulic fluid 21 into the fluid conductor 54 to extend the retractable hinge pin 84.

A fastener assembly 26 is also shown in this embodiment.

The fastener assembly can lock the first elevator segment 14 with the second elevator segment 18.

In embodiments, the dual opening elevator is comprised of two elevator segments capable of being attached, or locked together, each elevator segment having a cavity that fits a drill pipe. Each cavity forms a portion of the drill pipe opening which is only formed when the elevator segments are locked together.

The cavity in embodiments is shown as a semicircular shape to best fit a drill pipe, but can be shaped differently as required by various applications.

In embodiments, drill pipes used in oilfield applications can have a larger diameter segment and a reduced diameter segment with a chamfer transitioning the diameters. The cavity can have features included, such as an 18 degree chamfer to be used as a seating surface for drill pipes conforming to American Petroleum Institute (API) standards. In the alternative, the cavity can be sized to fit a drill pipe at a diameter less than the larger diameter of the drill pipe along the chamfer, or at the reduced diameter.

The elevator segments can be identical in shape and size for ease of manufacturing. When the elevator segments are locked closed, they will be capable of liftably supporting a drill pipe or other equipment within the opening.

In embodiments, the elevator segments are attached together using a plurality of fastener assemblies. Detaching any fastener assemblies connecting one side of the elevator segments can allow the elevator segments to open, or separate to allow the insertion of a drill pipe. Detaching all the fastener assemblies can allow the elevator segments to be completely separated for maintenance or cleaning purposes.

In embodiments, the fastener assemblies can be selected for easy attachment and removal to speed the operation of the dual opening elevator.

In embodiments, upon detaching fastener assemblies on one side of the elevator segments, the elevator segments can be opened by utilizing a rotary actuator.

The rotary actuator can be a manual mechanical means, such as a lever or a pulley. The rotary actuator can be an automated means, such as a hydraulic actuator, a pneumatic actuator, an electric actuator, a mechanical actuator, or combinations thereof, that can be operated without manual manipulation, such as by computer control.

In embodiments, the dual opening elevator can include an elevator rotator for rotating the dual opening elevator in a direction around the lower eye assembly of the link. The movement can be a rotary motion perpendicular to an axis through the lower eye assembly.

In embodiments the elevator rotator is particularly useful when the link moves the dual opening elevator in a pendulum motion. In this instance, the elevator rotator can be used to maintain the dual opening elevator in a horizontal orientation. The elevator rotator however, can be used for orienting the dual opening elevator for various applications.

In embodiments the elevator rotator can be a manual mechanical means, such as a lever or a pulley. The elevator rotator can be an automated means, such as a hydraulic actuator, a pneumatic actuator, an electric actuator, a mechanical actuator, or combinations thereof, that can be operated without manual manipulation, such as by computer control.

In embodiments, the dual opening elevator can have an eye assembly attached to the rotary actuator and the adapter. The eye assembly can facilitate the attachment of the adapter to the rotary actuator.

Various bearings, bearing retainers, and fastener assembly can be used for the purposes of attaching the eye assembly to the adapter, or attaching the eye assembly to the rotary actuator. One such embodiment is described above and shown in the figures as an example. In another embodiment the dual operating elevator can be used without a bearing.

While these embodiments have been described with emphasis on the embodiments, it should be understood that within the scope of the appended claims, the embodiments might be practiced other than as specifically described herein.

What is claimed is:

1. A drilling rig for use with a drill pipe having a drill bit in a wellbore, the drilling rig comprising:

a. a derrick centered over the wellbore, wherein the derrick has a crown and the derrick is attached to a drilling rig base;

b. at least one sheave mounted to the crown of the derrick;

c. a cable mounted to the at least one sheave;

d. a lifting block connected to the cable;

e. a top drive suspended from the lifting block;

f. a pair of links connected to the top drive;

g. a dual opening elevator suspended by at least one link attached to the top drive, wherein the dual opening elevator comprises:

(i) a first elevator segment with a first cavity;

(ii) a second elevator segment with a second cavity, wherein the first elevator segment is adapted to be locked closed with the second elevator segment or oriented in an open position with the second elevator segment; and wherein the first cavity and the second cavity form a drill pipe opening and when the first elevator segment and the second elevator segment are locked closed drill pipe is engageable and liftably supported by the drill pipe opening;

(iii) a first fastener assembly for engaging the first elevator segment with the second elevator segment forming a first opening when unfastened, and for locking the first elevator segment closed to the second elevator segment when fastened;

(iv) a second fastener assembly for engaging the first elevator segment with the second elevator segment forming a second opening when unfastened, and for locking the first elevator segment closed to the second elevator segment when fastened; and (v) at least one rotary actuator connected to a power source of the top drive, wherein the rotary actuator applies a force to the first elevator segment or the second elevator segment to displace the corresponding elevator segment to provide torque to open or close the corresponding elevator segment and create the first opening or the second opening between the first elevator segment and the second elevator segment; and wherein the first elevator segment and the second elevator segment are locked closed when the first fastener assembly and the second fastener assembly are concurrently fastened, and the first fastener assembly or the second fastener assembly can be selectively unfastened to allow the first elevator segment or the second elevator segment to form the first opening or the second opening alternatingly to support or release the drill pipe held in the drill pipe opening wherein the power source is used for moving the fastener assemblies, the rotary actuator, and the elevator rotators; and wherein the power source is at least one of:

a. a hydraulic system;

b. a mechanical system;

c. a pneumatic system; and d. an electrical system, said power source comprising:

a. a retractable hinge pin in a hinge pin housing;

b. a bore inside of the retractable hinge pin;

c. a piston cylinder comprising a piston chamber;

d. a first seal positioned between the piston cylinder and the retractable hinge pin;

e. a hinge pin housing head in communication with the piston chamber;

f. a retract passage between the piston chamber and a retract area;

g. a retract port in the hinge pin housing head for retracting said pin into the hinge pin housing;

h. an extend port in the hinge pin housing head for extending said pin into at least one of the first elevator segment and the second elevator segment;

i. a second seal positioned between the piston cylinder and the retractable hinge pin, wherein the second seal is mounted within a second seal groove formed in the retractable hinge pin.

2. The drilling rig of claim 1, wherein the first cavity and the second cavity have a customized created mechanical feature to match an inserted drill pipe, the mechanical feature comprising:

a. a conical shoulder;

b. a ledge;

c. a coating;

d. a protrusion; or e. a roughened surface.

3. The drilling rig of claim 1, wherein the first elevator segment is substantially identical to the second elevator segment.

4. The drilling rig of claim 1, wherein the first fastener assembly is substantially identical to the second fastener assembly.

5. The drilling rig of claim 1, wherein each fastener assembly rotates about a fastener axis to open and close the dual opening elevator.

6. The drilling rig of claim 1, wherein the fastener assembly comprises a hex shaped pin.

7. The drilling rig of claim 1, further comprising at least one elevator rotator for pivoting the dual opening elevator within an eye assembly of the link.

8. The drilling rig of claim 7, wherein the elevator rotator is selected from the group consisting of: a hydraulic actuator, a pneumatic actuator, an electric actuator, or a mechanical actuator.

9. The drilling rig of claim 1, wherein the rotary actuator is selected from the group consisting of: a hydraulic actuator, a pneumatic actuator, an electric actuator, or a mechanical actuator.

10. The drilling rig of claim 1, wherein the first fastener assembly and the second fastener assembly are a hinge pin.

11. The drilling rig of claim 10, wherein the first fastener assembly and the second fastener assembly are each a retractable hinge pin assembly.

12. The drilling rig of claim 7, further comprising an adapter connected to the eye assembly using an attaching means, the adapter comprising:

a. a first connection to the first elevator segment or the second elevator segment allowing the adapter to transfer a force to the first elevator segment or the second elevator segment;

b. a plurality of connectors to receive the force from the rotary actuator;

c. a second connection engaging the elevator rotator, allowing for rotation within the eye assembly of the link; and d. a bearing shaft for each bearing in the adapter.

13. The drilling rig of claim 12, wherein the adapter further comprises a stop surface for contacting and applying force against the link to limit the movement of the first elevator segment and second elevator segment.

14. The drilling rig of claim 7, wherein the eye assembly comprises:

a. an eye housing;

b. a small end connection to the rotary actuator formed in the eye housing;

c. a bearing retainer within the eye housing opposite the small end connection;

d. a bearing contained within the bearing retainer for allowing angular changes and rotational movement of one of the elevator segments; and e. an attaching pin for connecting the eye assembly to the rotary actuator.

15. The drilling rig of claim 14, wherein the bearing is substantially spherical.

16. The drilling rig of claim 1, wherein each rotary actuator attaches to a clevis disposed on the link, wherein the clevis allows each rotary actuator to move axially along the link using a slot, wherein each rotary actuator is displaced a distance sufficient to compensate for any axial movement of the first elevator segment or second elevator segment with respect to the link.

17. The drilling rig of claim 1, further comprising:

a. a drawworks connected to a drawworks motor for raising or lowering the lifting block;

b. a blowout preventer stack positioned over the wellbore with the drill pipe passing through the blowout preventer stack;

c. a mud pump connected to the drill pipe for use while the drill bit rotates;

d. a rig power supply for powering the drawworks motor;

e. a controller in communication with the top drive; and f. a pair of slips disposed on top of the wellbore above the blowout preventer stack and the drill bit.

* * * * *